US007009467B2

(12) United States Patent
Sawicki

(10) Patent No.: US 7,009,467 B2
(45) Date of Patent: Mar. 7, 2006

(54) DIRECTIONAL COUPLER

(75) Inventor: Andrzej Sawicki, Märsta (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 9 days.

(21) Appl. No.: 10/497,204

(22) PCT Filed: Nov. 27, 2002

(86) PCT No.: PCT/SE02/02181

§ 371 (c)(1),
(2), (4) Date: Jul. 20, 2004

(87) PCT Pub. No.: WO03/047024

PCT Pub. Date: Jun. 5, 2003

(65) Prior Publication Data

US 2005/0017821 A1 Jan. 27, 2005

(30) Foreign Application Priority Data

Nov. 30, 2001 (SE) ..... 0104039

(51) Int. Cl.
*H01P 5/18* (2006.01)

(52) U.S. Cl. ..... 333/116; 333/238

(58) Field of Classification Search ..... 333/109, 333/116, 118, 238, 26

See application file for complete search history.

(56) References Cited

U.S. PATENT DOCUMENTS

| | | | | |
|---|---|---|---|---|
| 5,313,175 | A | 5/1994 | Bahl et al. | |
| 5,629,654 | A | 5/1997 | Frick | 333/116 |
| 5,745,017 | A * | 4/1998 | Ralph | 333/116 |
| 6,140,886 | A * | 10/2000 | Fratti et al. | 333/26 |
| 6,208,220 | B1 | 3/2001 | Logothetis | |

FOREIGN PATENT DOCUMENTS

| | | |
|---|---|---|
| DE | 19858470 A1 * | 6/2000 |
| JP | 11-150405 | 6/1999 |
| JP | 2000-165116 | 6/2000 |
| WO | 98/12769 | 3/1998 |

OTHER PUBLICATIONS

Sachese et al; "Quasi-Ideal Multilayer Two- and Three-Strip Directional Couplers for Monolithic and Hybrid MICs"; In: IEEE Transactions on Microwave Theory and Techniques, Sep. 1999, vol. 47, issue 9, part 2, Sidorna, pp. 1873-1882.

* cited by examiner

*Primary Examiner*—Dean Takaoka
(74) *Attorney, Agent, or Firm*—Nixon & Vanderhye, P.C.

(57) ABSTRACT

A multilayer coupled-lines directional coupler of the quarter wavelength type comprises a first, a second and a third conductive layer, joined by means of dielectric layers. The first conductive layer comprises a first and a second conductive strip, separated, mutually parallel, each in one end connected to a first output and in another end connected to a second output. The second conductive layer comprises a third conductive strip, parallel to the first and the second conductive strip, in one end connected to a third output and in another end connected to a fourth output. The first conductive layer comprises a fourth conductive strip, parallel to and located between the first and the second conductive strip, in one end connected to the third output, and in another end connected to the fourth output.

8 Claims, 3 Drawing Sheets

DIRECTIONAL COUPLER

This application is the US national phase of international application PCT/SE02/02181 filed in English on 27 Nov. 2002, which designated the US. PCT/SE02/02181 claims priority to SE Application No. 0104039.3 filed 30 Nov. 2001. The entire contents of these applications are incorporated herein by reference.

TECHNICAL FIELD

The present invention relates to a multilayer coupled-lines directional coupler of the quarter wavelength type.

BACKGROUND

Directional couplers are widely used in microwave and RF circuits as separate components, or as parts of other devices. They are used separately for power dividing/combining, for power monitoring and isolation of dc components. They are parts of the following devices: directional filters, mixers, phase shifters, attenuators, balanced amplifiers, magic-tees, modulators, beam-forming networks for array antennas, etc.

Directional couplers can utilize different waveguiding media, for example waveguides, coaxial lines, printed transmission lines—like microstrip, strip-lines, coplanar lines, etc. Printed directional couplers use pieces of single or coupled lines placed on, or between, planar dielectric substrates. Directional couplers made of coupled lines have wider frequency bandwidth.

There are many of known configurations of coupled-line directional couplers. The typical structure can utilize coplanar-coupled or broad-edge-coupled microstrip or strip-line transmission structures. Prior art microstrip and coplanar structures, cross sections of which are shown in FIGS. 1(*a*), (*b*) and (*c*), utilize paired parallel transmission lines in the same horizontal plane. They function predominantly as inductive coupling structures, which means that the inductive coupling coefficient is greater than the capacitive one. As seen in FIG. 2, the broad edge-coupled structure positions the coupled transmission lines such that the second line overlaps the first one along the vertical axis. The broad-edge topology functions predominantly as a capacitive coupling structure. In this case the capacitive coupling coefficient is greater than the inductive one. If coupling coefficients are different, a coupler is 'not compensated', and has poor directivity. Among the many techniques that can be used to equilize the inductive and capacitive coupling coefficients (to compensate a coupler) include the use of: an overlay dielectric medium, composite substrate of different materials, suspended substrate, splitted conductors, a parallel slot or a tuning septum in the ground plane (see, for example, K. Sachse, A. Sawicki, Quasi-Ideal Multilayer Two- and Three-Strip Directional Couplers for Monolithic and Hybrid MICs, IEEE Transactions on Microwave Theory and Techniques, vol. 47, No. 9, September 1999, pp. 1873–1882). Uniaxial dielectric materials, wiggled coupled lines, and external compensation with lumped capacitors is also used—the latest one allows only narrow frequency band compensation. Some of the mentioned above techniques are suitable for weakly coupled lines, some of them—for tightly coupled lines. In multilayer topologies vertical connections to the input and output lines (see for example U.S. Pat. No. 6,208,220 B1, and JP63043402 patents), or between the multiple coupled lines (see for example U.S. Pat. No. 5,629,654 patent) are provided utilizing via-holes. Vertical interconnections can be easily applied in printed circuit board (PCB), low temperature cofired ceramic (LTCC), and microwave monolithic integrated circuits (MMIC) technologies.

The known configurations of coupled-lines structures manufacured in PCB or LTCC technologies are not compensated. In most common cases a final board is built of a few layers of substrates with the same dielectric permittivity. The compensation technique of using dielectric substrates with different dielectric permittivities can be seldom applied. Weakly coupled lines can be compensated using lumped capacitors mounted on the top layer, or tooth- or comb-type shape of coupled lines can be used. Unfortunately, these techniques are very sensitive on dimensions tolerances of the printed lines, and on tolerances of parameters of the applied components. There is not any known technique to compensate tightly-coupled lines manufactured in the classical PCB or LTCC technology, where the same dielectric material is used to build a multilayer coupled-lines structure. The use of different dielectric materials results in a more complicated manufacturing process, and therefore relatively high costs. Additionally, different dielectric materials have different coefficients of thermal expansion. The difference of said coefficients will cause a temperature change to induce stresses in the substrates. It is difficult to find dielectric substrates with similar thermal coefficients and the required values of dielectric permittivity at the same time. Moreover, to bond different substrate materials a thermoplastic or a thermoset film must be used, which is adapted to bond the two specific materials together. Such films are difficult, if not impossible to obtain.

SUMMARY

It is an object of the present invention to present a multilayer coupled-lines directional coupler of the quarter wavelength type that, with a relatively simple arrangement, presents a high efficiency.

It is also an object of the present invention to present a multilayer coupled-lines directional coupler of the quarter wavelength type that combines a high efficiency with low manufacturing costs.

These objects are achieved by a multilayer coupled-lines directional coupler of the quarter wavelength type comprising a first, a second and a third conductive layer, being essentially planar, essentially parallel and located at a distance from each other, the second conductive layer being located between the first and the third conductive layer, the first and the second conductive layer being joined by means of at least one intermediate dielectric layer and the second and the third conductive layer also being joined by means of at least one intermediate dielectric layer, the first conductive layer comprising a first and a second conductive strip, with extended shapes, in a conductive material, separated, essentially mutually parallel, each in one end connected to a first output and each in another end connected to a second output, the second conductive layer comprising a third conductive strip, with an extended shape, in a conductive material, essentially parallel to the first and the second conductive strip, in one end connected to a third output and in another end connected to a fourth output, and the third conductive layer comprising a first ground plane, whereby the first conductive layer comprises a fourth conductive strip, with an extended shape, in a conductive material, located between the first and the second conductive strip, in one end connected to the third output, and in another end connected to the fourth output.

The configuration according to the invention allows for the design of multilayer coupled-lines directional couplers to be manufactured using substrates with the same dielectric permittivity, whereby the couplers are substantially compensated, present good directivity and can therefore be regarded as efficient. Especially when used in PCB or LTCC technology, the invention presents very large advantages over known couplers. However, the invention also allows for directional couplers to be manufactured with technologies other than PCB or LTCC, and also with substrates presenting different dielectric permittivity in relation to each other.

In particular, the second conductive layer comprises a fifth conductive strip, with an extended shape, in a conductive material, essentially parallel to the third conductive strip, in one end connected to the third output and in another end connected to the fourth output. This provides for a wider range of coupling coefficients.

Preferably, the at least one dielectric layer joining the first and the second conductive layer and the at least one dielectric layer joining the second and the third conductive layer present essentially the same dielectric permittivity. This embodiment provides a directional coupler that combines the features of being compensated and at the same time provides for an easy manufacturing procedure, using only one dielectric material for the substrates. There are no problems with different coefficients of thermal expansion of the substrates. Readily available materials can be used for bonding the substrates. Either the same dielectric material could be used, or different materials with essentially the same dielectric permittivity could be used.

Preferably, the first and the second conductive strip are connected to each other at their ends, the fourth conductive strip is connected to the third and fourth output through the respective ends of the third conductive strip and the third and the fourth conductive strip are connected to each other essentially in the middle of the third and the fourth conductive strip. Thereby, the number of field modes of the directional coupler will essentially be limited to two.

Preferably, the fourth conductive strip is connected to the third conductive strip by means of at least one via-hole. This provides for an easy manufacturing process since via-holes are recognized as being supported by standard technology to achieve connections between different layers of a multilayer structure.

Preferably, the first and/or the second conductive layer comprises a ground plane. This will help to compensate the coupler, especially for week couplings.

DESCRIPTION OF THE FIGURES

Below, the invention will be described in greater detail with the aid of the accompanying drawings, in which FIGS. 1(*a*), 1(*b*), 1(*c*) and 2 show cross-sectional views of microstrip directional couplers according to prior art.

DETAILED DESCRIPTION

Figure 1A:
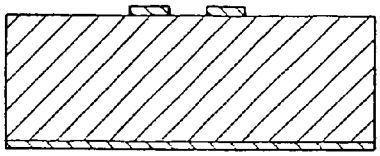
Figure 1B:
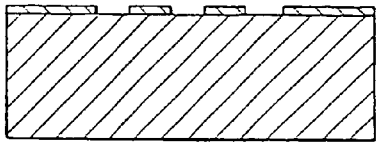
Figure 1C:
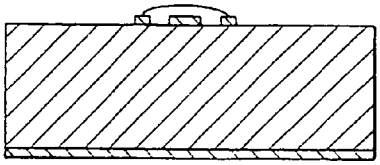
Figure 2:
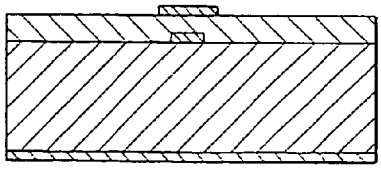
Figure 4:
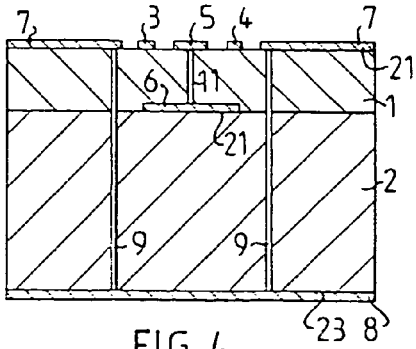
FIG. 4 shows a cross-sectional view of the directional coupler shown in FIG. 3, the section located along the line IV—IV in FIG. 3.
Figure 3:
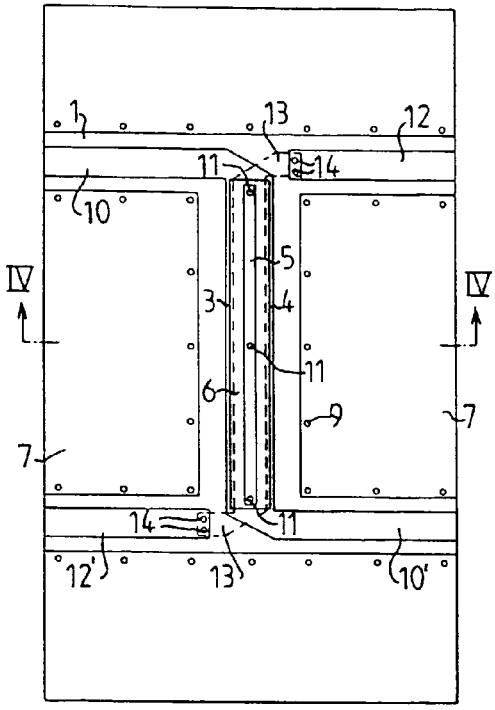
FIG. 3 shows a plan view of a directional coupler (with hidden parts indicated with broken lines) according to a first embodiment of the invention.

FIGS. 3 and 4 show a multilayer coupled-lines directional coupler of the quarter wavelength type according to a first embodiment of the invention. This is suitable for PCB, LTCC, and other multilayer technologies applications. As can be seen in FIG. 4 the directional coupler comprises a first 1 and a second 2 dielectric layer. The first 1 and the second 2 dielectric layer can present the same dielectric permittivity.

The directional coupler comprises a first 21, a second 22 and a third 23 conductive layer, being essentially planar, essentially parallel and located at a distance from each other. The second conductive layer 22 is located between the first 1 and the second 2 dielectric layer. The first conductive layer 21 is located on the face of the first dielectric layer 1 being opposite to the face at which the second conductive layer 22 is located. The third conductive layer 23 is located on the face of the second dielectric layer 2 being opposite to the face at which the second conductive layer 22 is located.

The third conductive layer 23 comprises a first ground plane 8, and the first conductive layer 21 comprises a plurality of second ground planes 7. As can be seen in FIG. 4 the first ground plane 8 is connected to the second ground planes 7 by means of via-holes 9. Via-holes, as is known in the art, are produced by perforating the assembled structure at suitable locations and filling the holes with a conductive material, to produce an electrical connection between different conductive layers of the structure.

Figure 5:
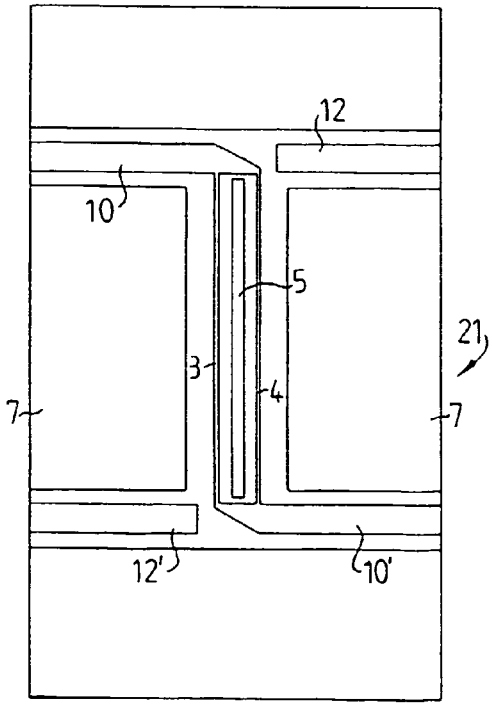
FIG. 5 shows a plan view of a conductive layer in the directional coupler shown in FIG. 3.

As can be seen in FIGS. 4 and 5, the first conductive layer 21 comprises a first 3 and a second 4 conductive strip, with extended shapes, in a conductive material and separated. The first 3 and the second 4 conductive strip are essentially parallel, each in one end connected to a first output 10 and each in another end connected to a second output 10'. Preferably they are also connected to each other at their ends.

Figure 6:
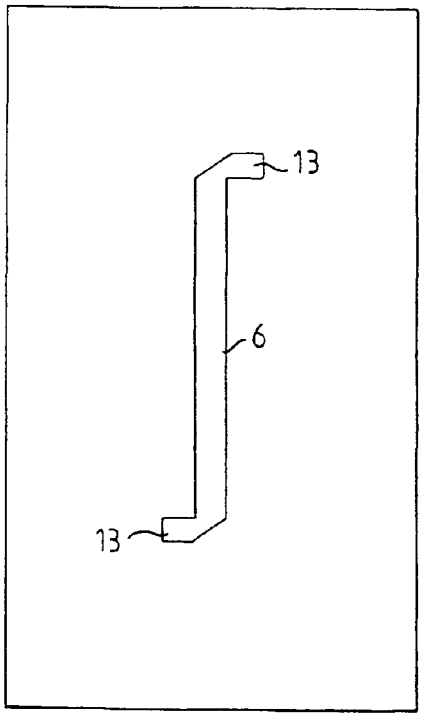
FIG. 6 shows a plan view of another conductive layer in the directional coupler shown in FIG. 3.

As can be seen in FIGS. 4 and 6, the second conductive layer comprises a third conductive strip 6, with an extended shape and in a conductive material. The third conductive strip 6 is essentially parallel to the first 3 and the second 4 conductive strip. As can be seen in FIG. 6, at each end the third conductive strip 6 is connected to a transition line 13, by means of which, as will be described below, the third conductive strip 6 is connected to the first conductive layer 21.

In FIG. 3, in which the third conductive strip 6 and transition lines 13 are indicated with broken lines, it can be seen that one of the transition lines 13 is connected with via-holes 14 to a third output 12 and the other of the transition lines 13 is connected with via-holes 14 to a fourth output 12'.

As can be seen in FIGS. 4 and 5, the first conductive layer 21 comprises a fourth conductive strip 5, with an extended shape and in a conductive material. The fourth conductive strip 5 is essentially parallel to and located between the first 3 and the second 4 conductive strip. It is in one end connected to the third output 12, with the aid of a via-hole 11, which is connected to the third conductive strip 6, which in turn is connected to one of the transition lines 13, which is connected to the third output 12 by means of two via-holes 14. In another end the fourth strip 5 is connected in a similar manner to the fourth output 12'. Alternatively, different numbers of via-holes can be used for each connection. As a further alternative, another form of connection can be used between the ends of the fourth strip 5 and the third and fourth output.

In FIG. 3 it can also be seen that the fourth strip 5 is connected to the third strip 6 by a via-hole 11 at a middle portion of the strips. Alternatively, this connection can be omitted. As a further alternative additional connections can be provided between the fourth strip 5 and the third strip 6, on various locations. The arrangement of the via-hole 11 at a middle portion of the strips 5, 6, together with the first 3 and the second 4 strip being connected to each other at their ends, has the advantage that the number of field modes of the directional coupler will essentially be limited to two.

Thus, the directional coupler is provided by the first and second strips 3, 4 being connected planarly and the third and fourth strips 5, 6 being connected vertically.

Figure 7:
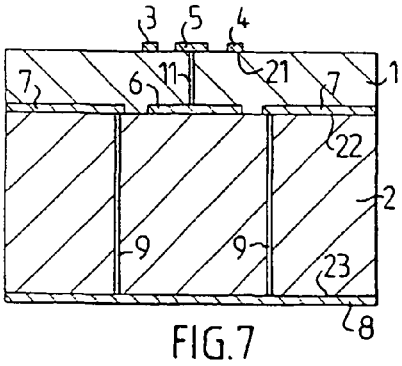
FIG. 7 shows a cross-sectional view of a directional coupler according to a second embodiment of the invention.

The directional coupler shown in FIGS. 3, 4, 5, and 6 utilizes coplanar ground planes 7 on the first conductive layer, which help to compensate the coupler. According to a second embodiment of the invention illustrated in FIG. 7, the ground planes 7 can be shifted from the first conductive layer 21 to the second one 22, and connected to the bottom ground plane 8 utilizing via-holes 9.

Figure 8:
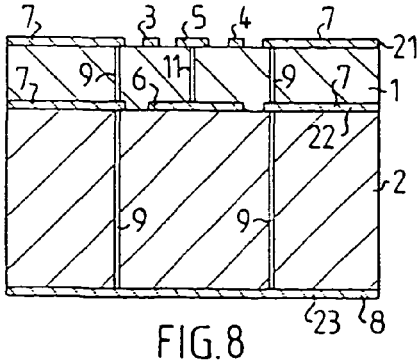
FIG. 8 shows a cross-sectional view of a directional coupler according to a third embodiment of the invention.
Figure 11:
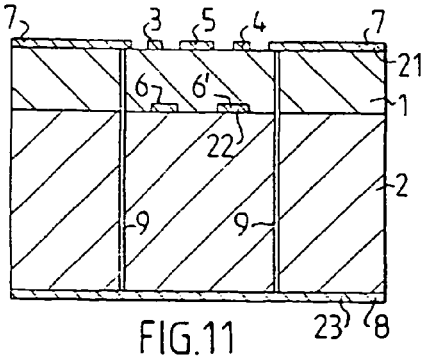
FIG. 11 shows a cross-sectional view of the directional coupler shown in FIG. 10, the section located along the line XI—XI in FIG. 10.
Figure 12:
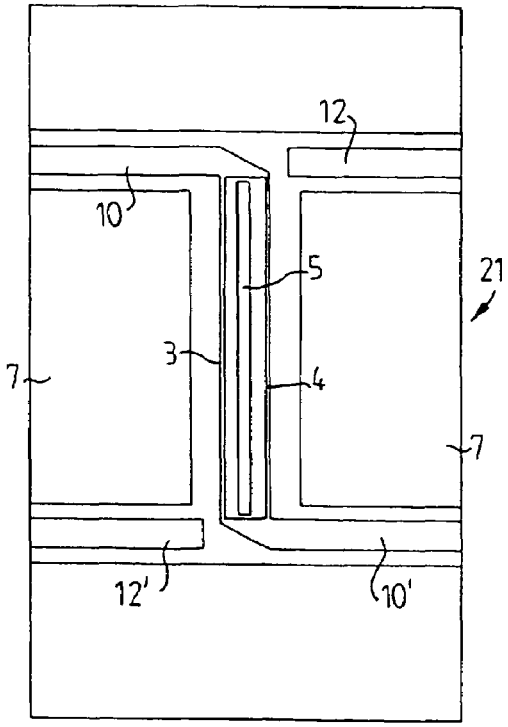
FIG. 12 shows a plan view of a conductive layer in the directional coupler shown in FIG. 10.

According to a third embodiment of the invention illustrated in FIG. 8, the ground planes 7 can be applied at both the first 21 and the second 22 conductive layer. Thereby, the ground planes 7 should be connected together using via-holes 9, and should be connected to the ground plane 8 by via-holes 9.

Figure 9:
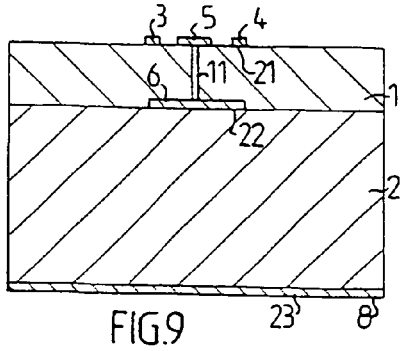
FIG. 9 shows a cross-sectional view of a directional coupler according to a fourth embodiment of the invention.

According to a fourth embodiment of the invention illustrated in FIG. 9, preferably to be used for a compensated tightly coupled directional coupler or if it is not necessary to compensate a weakly coupled coupler, which means that the weakly coupled coupler can operate with degraded parameters, coplanar ground planes 7 can be omitted altogether. The ground planes 7 can be also omitted if different dielectric material is used for the first 1 and the second 2 dielectric layer, and compensation of the coupler is then possible.

The novel coupled lines structure allows to achieve a wide range of coupling coefficients. For example, achievable coupling levels in which the coupler is compensated, are −10 dB to −2.7 dB for BT-Epoxy substrates and 0.2 to 1.0 normalized thicknesses of the first 1 and the second 2 dielectric layers, respectively.

FIGS. 10–13 show a directional coupler according to a fifth embodiment of the invention. Here (FIG. 11), the second conductive layer 22 comprises a fifth conductive strip 6', with an extended shape and in a conductive material. The fifth conductive strip 6' is essentially parallel to the third conductive strip 6, and as the latter, in one end connected to the third output 12 and in another end connected to the fourth output 12'. The third 6 and the fifth 6' conductive strip are arranged symmetrically in relation to the fourth strip 5 on the first conductive layer 21. Thus, the third 6 and the fifth 6' conductive strip are connected planarly and also connected to the fourth strip 5 using via-holes 11.

Figure 10:
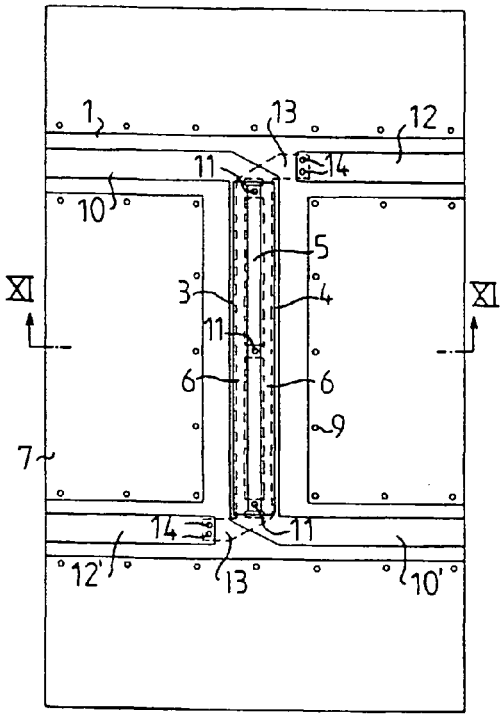
FIG. 10 shows a plan view of a directional coupler (with hidden parts indicated with broken lines) according to a fifth embodiment of the invention.
Figure 13:
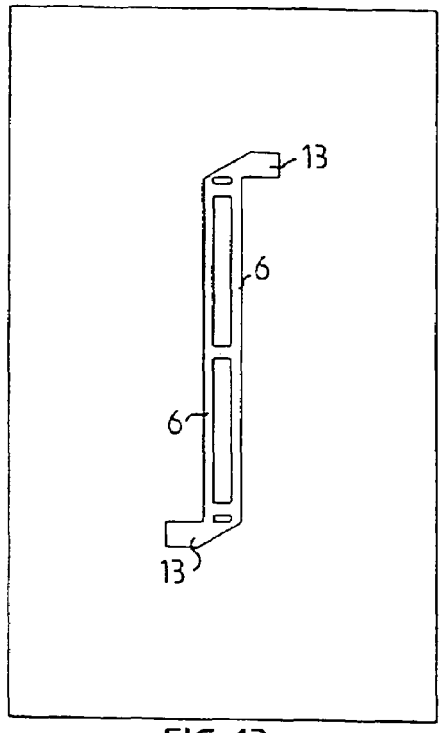
FIG. 13 shows a plan view of another conductive layer in the directional coupler shown in FIG. 10.

As can be seen in FIG. 13 the third 6 and fifth 6' strip are joined at a middle portion of the strips, to accommodate a connection through a via-hole 11, shown in FIG. 10, to the fourth strip 5. As an alternative this connection can be omitted.

The directional coupler as shown in FIGS. 10–13 provides for a wider range of coupling coefficients.

The directional coupler according to the invention is not sensitive to lateral misalignment of conductive layers, which is very important in mass production. For example for a coupler in which the width of the first 3 and second 4 strip is 0.33 mm, respectively, the width of the third strip 6 is 0.64 mm and the width of the fourth strip 5 is 0.28 mm, a 0.2 mm horizontal shift of the second conductive layer (including the third strip 6) changes coupling coefficient from 0.717 to 0.725, and impedances from 50 ohms to 48.5 ohms, for a 3 dB coupler realized using BT-Epoxy substrates. Variation of dielectric permittivity of the first dielectric substrate 1 from 4.2 to 4.4 does not change the coupling coefficient, and changes impedances from 51 ohms to 49 ohms, for the same coupler.

Figure 14:
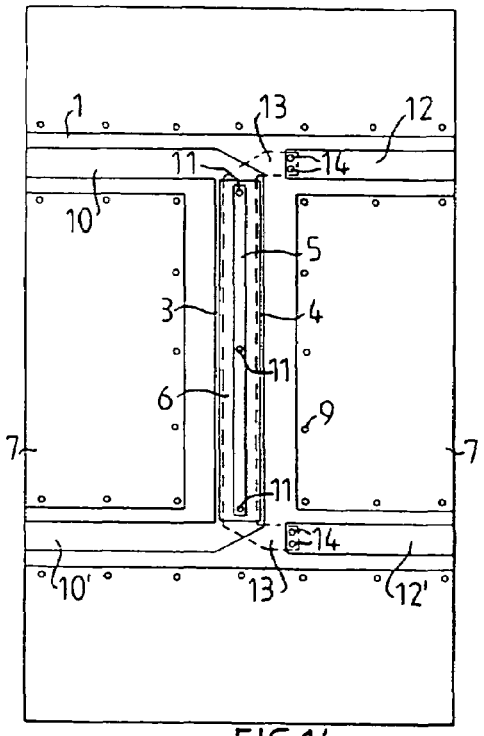
FIG. 14 shows a plan view of a directional coupler (with hidden parts indicated with broken lines) according to a sixth embodiment of the invention.

The invention allows bending the output lines in two ways. One way is shown in the embodiments described above (see e.g. FIG. 3). A second way to arrange the output lines is shown in FIG. 14. Here the first 10 and the second 10' outputs are located on the same side of the conductive strips 3–6, and the third 12 and the fourth 12' outputs are located on the side of the conductive strips 3–6 being opposite to the side at which the first 10 and the second 10' outputs are located. The configuration shown in FIG. 3 (described above) is conveniently used for design of balanced microwave devices like mixers, modulators and amplifiers.

Above, the conductive layers have been shown as separated by two dielectric layers. Alternatively, two or more dielectric layers can be used to separate two of the conductive layers. Thereby, two or more dielectric layers can be used to separate the first and the second conductive layer and/or two or more dielectric layers can be used to separate the second and the third conductive layer. Specifically, in LTCC technology, the second dielectric layer 2 described above can comprise a plurality of dielectric substrates.

In the embodiments described above the conductive strips have been located symmetrically in relation to each other. However, the coupler according to the invention does not have to be symmetrical. For example, the third 6 (and the fifth 6') strip can be located asymmetrically in relation to the first 3, second 4 and forth 5 conductive strips.

Figure 15:
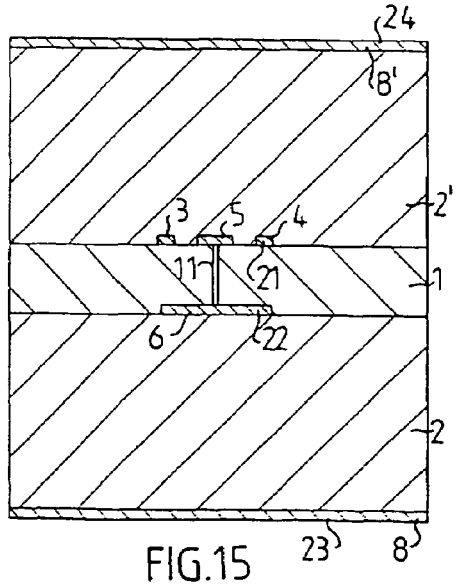
FIG. 15 shows a cross-sectional view of a directional coupler according to a seventh embodiment of the invention.

FIG. 15 shows a cross-sectional view of a directional coupler according to a seventh embodiment of the invention. As in the embodiments described above it comprises a first 21, a second 22 and a third 23 conductive layer, the first and the second conductive layers 21, 22 being joined by a first dielectric layer 1, and the second and the third conductive layers 22, 23 being joined by a second dielectric layer 2. As in the embodiments described above, the third conductive layer 23 comprises a first ground plane 8.

Conductive strips 3, 4, 5, 6 are provided and arranged according to the fourth embodiment described above with reference to FIG. 9. However, according to the seventh embodiment the conductive strips 3, 4, 5, 6 can be arranged any of the alternative embodiments described above. For example, the coupler can be provided with a fifth conductive strip 6' described with reference to FIGS. 10–13 above. Additionally, the output lines of the coupler can be arranged in any of the manners described above, for example, as described with reference to FIG. 3 or 14.

According to the seventh embodiment of the invention, the coupler comprises a fourth conductive layer 24, including an additional ground plane 8'. The fourth conductive layer 24 is joined with the first conductive layer 21 by a third dielectric layer 2'. Preferably, all dielectric layers 1, 2, 2' are made of the same the material so as to present the same dielectric permittivity, which contributes to the coupler being compensated.

The coupler according to the seventh embodiment has a large advantage in that the electrical parameters of the coupler have a small sensitivity to lateral misalignment of the conductive layers and the conductive layers, and also a small sensitivity to the thickness of the first dielectric layer 1. This present an important advantage in mass production of the coupler, since a relatively large misalignment of the conductive layers can be accepted, which means that requirements on production accuracy can be kept relatively low, which in turn is cost saving.

What is claimed is:

1. A multilayer coupled-lines directional coupler of the quarter wavelength type comprising a first, a second and a third conductive layer, being essentially planar, essentially parallel and located at a distance from each other, the second conductive layer being located between the first and the third conductive layer, the first and the second conductive layer being joined by means of at least one intermediate dielectric layer and the second and the third conductive layer also being joined by means of at least one intermediate dielectric layer, wherein, that the first conductive layer comprises a first and a second conductive strip, with extended shapes, in a conductive material, separated, essentially mutually parallel, each in one end connected to a first output and each in another end connected to a second output, that the second conductive layer comprises a third conductive strip, with an extended shape, in a conductive material, essentially parallel to the first and the second conductive strip, in one end connected to a third output and in another end connected to a fourth output, that the third conductive layer comprises a first ground plane, and that the first conductive layer comprises a fourth conductive strip, with an extended shape, in a conductive material, located between the first and the second conductive strip, in one end connected to the third output, and in another end connected to the fourth output.

2. A multilayer coupled-lines directional coupler according to claim 1, wherein the second conductive layer comprises a fifth conductive strip, with an extended shape, in a conductive material, essentially parallel to the third conductive strip, in one end connected to the third output and in another end connected to the fourth output.

3. A multilayer coupled-lines directional coupler according to claim 1, wherein the at least one dielectric layer joining the first and the second conductive layer and the at least one dielectric layer joining the second and the third conductive layer present essentially the same dielectric permittivity.

4. A multilayer coupled-lines directional coupler according to claim 1, wherein the first and the second conductive strip are connected to each other at their ends, in that the fourth conductive strip is connected to the third and fourth output through the respective ends of the third conductive strip and in that the third and the fourth conductive strip are connected to each other essentially in the middle of the third and the fourth conductive strip.

5. A multilayer coupled-lines directional coupler according to claim 1, wherein the fourth conductive strip is connected to the third conductive strip by means of at least one via-hole.

6. A multilayer coupled-lines directional coupler according to claim 1, wherein the first and/or the second conductive layer comprises a ground plane.

7. A multilayer coupled-lines directional coupler according to claim 1, wherein it comprises a fourth conductive layer, including an additional ground plane, the fourth and the first conductive layer being joined by means of at least one intermediate dielectric layer.

8. A multilayer coupled-lines directional coupler according to claim 7, wherein the at least one dielectric layer joining the first and the fourth conductive layer, the at least one dielectric layer joining the first and the second conductive layer, and the at least one dielectric layer joining the second and the third conductive layer present essentially the same dielectric permittivity.

* * * * *